US008327830B2

(12) United States Patent
Makino et al.

(10) Patent No.: US 8,327,830 B2
(45) Date of Patent: Dec. 11, 2012

(54) FUEL VAPOR PROCESSING APPARATUS

(75) Inventors: Katsuhiko Makino, Aichi-ken (JP); Junya Kimoto, Obu (JP); Masanobu Shinagawa, Aichi-ken (JP); Takashi Mani, Hekinan (JP)

(73) Assignee: Aisan Kogyo Kabushiki Kaisha, Aichi-Ken (JP)

( * ) Notice: Subject to any disclaimer, the term of this patent is extended or adjusted under 35 U.S.C. 154(b) by 437 days.

(21) Appl. No.: 12/781,004

(22) Filed: May 17, 2010

(65) Prior Publication Data

US 2010/0288242 A1 Nov. 18, 2010

(30) Foreign Application Priority Data

May 18, 2009 (JP) ..... 2009-119843

(51) Int. Cl.
*F02M 33/08* (2006.01)

(52) U.S. Cl. ..... 123/518; 123/519; 123/521

(58) Field of Classification Search ..... 123/514, 123/516, 518, 519, 520
See application file for complete search history.

(56) References Cited

U.S. PATENT DOCUMENTS

| | | | | |
|---|---|---|---|---|
| 6,786,207 | B2 * | 9/2004 | Kojima et al. | 123/516 |
| 7,261,092 | B1 * | 8/2007 | Oku et al. | 123/516 |
| 7,527,045 | B2 * | 5/2009 | Chung | 123/519 |
| 2009/0139495 | A1 * | 6/2009 | Crawford | 123/519 |
| 2010/0107877 | A1 * | 5/2010 | Suzuki et al. | 96/6 |
| 2010/0288021 | A1 * | 11/2010 | Makino et al. | 73/40.7 |
| 2010/0294251 | A1 * | 11/2010 | Makino et al. | 123/519 |
| 2011/0146491 | A1 * | 6/2011 | Suefuji et al. | 96/8 |
| 2011/0214646 | A1 * | 9/2011 | Makino | 123/518 |
| 2011/0247595 | A1 * | 10/2011 | Ogita et al. | 123/521 |
| 2012/0085325 | A1 * | 4/2012 | Makino et al. | 123/521 |

FOREIGN PATENT DOCUMENTS

| | | | |
|---|---|---|---|
| JP | 11-173223 | | 6/1999 |
| JP | 2002235808 | | 8/2002 |
| JP | 2004-353600 | | 12/2004 |
| JP | 2012-82751 | * | 4/2012 |
| JP | 2012-82752 | * | 4/2012 |
| JP | 2012-82753 | * | 4/2012 |

* cited by examiner

*Primary Examiner* — Hai Huynh
(74) *Attorney, Agent, or Firm* — Dennison, Schultz & MacDonald

(57) ABSTRACT

A fuel vapor processing apparatus includes a purge air supply device including separation device that can separate gas, which is introduced from within a fuel tank, into a fuel component and an air component. The air component is supplied into a canister for purging the canister.

11 Claims, 4 Drawing Sheets

FUEL VAPOR PROCESSING APPARATUS

This application claims priority to Japanese patent application serial number 2009-119843, the contents of which are incorporated herein by reference.

BACKGROUND OF THE INVENTION

1. Field of the Invention

The present invention relates to fuel vapor processing apparatus.

2. Description of the Related Art

A fuel vapor processing apparatus is known that includes a vapor passage for introducing fuel vapor, which is produced within a fuel tank of an automobile, into a canister, an atmospheric-side opening and closing device provided to the canister, a negative pressure generating device disposed within the fuel tank and generating a negative pressure, and a recovery passage communicating between the negative pressure generating device and the canister. The negative pressure generating device can operate for recovering fuel vapor stored within the canister into the fuel tank via the recovery passage.

This type of fuel vapor processing apparatus is disclosed, for example, in Japanese Laid-Open Patent Publication No. 2002-235608. As shown in FIG. 5, a fuel vapor processing apparatus 100 disclosed in this publication includes a vapor passage 104 for introducing fuel vapor, which is produced within a fuel tank T, into a canister 103, an atmospheric-side opening and closing valve 105 capable of opening the canister 103 into the atmosphere, a negative pressure generating device 107 disposed within the fuel tank T for generating a negative pressure, and a recovery passage 108 communicating between the negative pressure generating device 107 and the canister 103.

Fuel vapor may be produced within the fuel tank T, for example, during parking of the automobile and may be introduced into the canister 103 via the vapor passage 104. The fuel vapor is then adsorbed by an adsorption material (such as activated carbon) that is disposed within the canister 103. Therefore, it is possible to prevent the fuel vapor produced within the fuel tank from being leaked into the atmosphere.

In addition, the fuel vapor stored within the canister 103 may be drawn into the fuel tank T via the recovery passage 108 when the negative pressure generating device 107 is operated during driving of the automobile. The fuel component of the fuel vapor introduced into the fuel tank T is then recovered into the fuel.

However, according to the fuel vapor processing apparatus of the above publication, the internal pressure within the canister 103 becomes negative during recovering of the fuel vapor, and therefore, gas contained within the fuel tank T may flow from the vapor passage 104 into the canister 103. In other words, the adsorption material disposed within the canister 103 is purged by the gas supplied from within the fuel tank T. Because the gas contained within the fuel tank T includes fuel vapor, it is hard to effectively desorb the fuel vapor from the adsorption material when the gas is used for purging.

In order to solve this problem, it may be possible to open the atmospheric-side opening and closing valve 105 for introducing external air into the canister 103. However, if external air flows into the canister 103, the external air may be drawn into the fuel tank T via the recovery passage 108 to cause another problem of increase in the internal pressure of the fuel tank T.

Therefore, there is a need in the art for a fuel vapor processing apparatus that can inhibit increase in an internal pressure of a fuel tank and can improve the fuel vapor recovery efficiency.

SUMMARY OF THE INVENTION

A fuel vapor processing apparatus includes a purge air supply device including a separation device that can separate gas, which is introduced from within a fuel tank, into a fuel component and an air component. The air component is supplied into a canister for purging the canister.

DETAILED DESCRIPTION OF THE INVENTION

Figure 1A:
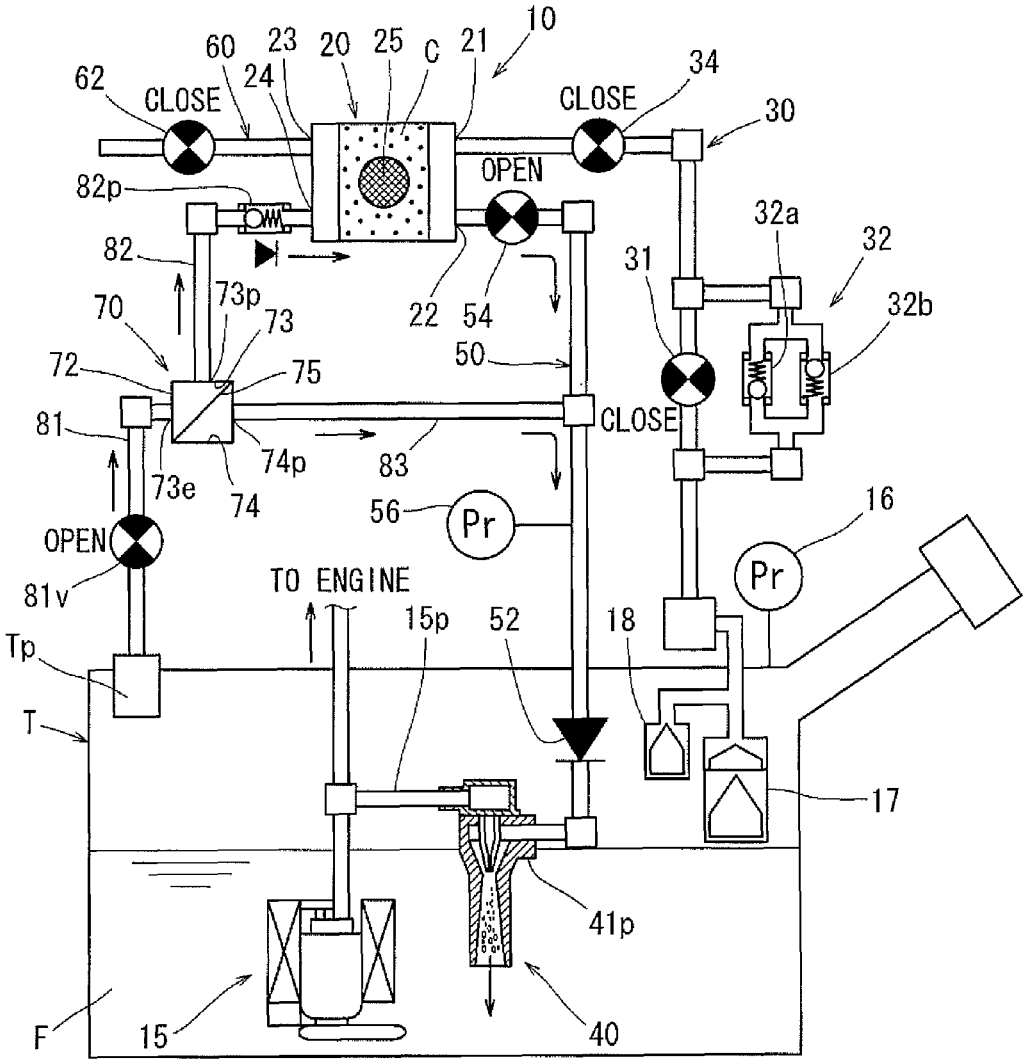
FIG. 1(A) is a schematic view of a fuel vapor processing apparatus according to an example.

Each of the additional features and teachings disclosed above and below may be utilized separately or in conjunction with other features and teachings to provide improved fuel vapor processing apparatus. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one example, a fuel vapor processing apparatus includes a vapor passage capable of introducing fuel vapor, which is produced within a fuel tank of an automobile, into a canister. The fuel vapor processing device further includes an atmospheric-side opening and closing device provided at the canister, a negative pressure generating device disposed within the fuel tank and capable of generating a negative pressure, and a recovery passage communicating between the negative pressure generating device and the canister, so that fuel vapor stored within the canister can be recovered into the fuel tank through the recovery passage by the operation of the negative pressure generating device. A vapor passage opening and closing device can open and close the vapor passage. A separating device can separate gas, which is introduced from within the fuel tank, into an air component and a fuel component. During recovering of fuel vapor contained in the canister into the fuel tank by the operation of the negative pressure generating device, on the condition that the atmospheric-side opening and closing mechanism and the vapor passage opening and closing device are closed, the air component separated from the gas by the separation device can be supplied to the canister.

Therefore, during the time when the fuel component contained in the canister is drawn by the negative pressure generating device, air is supplied to the canister from the separation device, so that the canister is purged with air. As a result, the recovering efficiency of fuel component contained in the canister can be improved.

In addition, the air supplied from the separation device is that remaining after removal of the fuel component. Therefore, even in the case that such air is drawn together with the fuel component contained in the canister by the negative pressure generating device, the internal pressure of the fuel tank may not increase.

The separation device may include a separation membrane through which a fuel component can easily pass but an air component is difficult to pass, a container separated into a primary chamber and a secondary chamber by the separation membrane, and a pressure difference producing device capable of producing a pressure difference between the primary chamber and the secondary chamber, so that gas within the fuel tank is introduced into the primary chamber, and the fuel component separated from the gas by the separation membrane is introduced into the second chamber.

Therefore, it is possible to separate gas, which is introduced from within the fuel tank, into an air component and a fuel component by a simple construction using the separation membrane.

Alternatively, the separation device may be a cooling container capable of cooling gas introduced from within the fuel tank, so that a fuel component of the gas is liquefied and an air component of the gas is separated from the gas.

EXAMPLES

An example will now be described with reference to FIGS. 1 to 4. A fuel vapor processing apparatus of this example can prevent or inhibit fuel vapor, which may be produced within a fuel tank T of an automobile, from being leaked into the atmosphere. This apparatus is also configured to be able to recover fuel vapor in to the fuel tank T.

(General Construction of Fuel Vapor Processing Apparatus)

Referring to FIG. 1(A), a fuel vapor processing apparatus 10 generally includes a canister 20 capable of adsorbing and desorbing fuel vapor, a vapor passage 30 for introducing fuel vapor produced within the fuel tank T into the canister 20, an aspirator 40 disposed within the fuel tank T for generating a negative pressure, a recovery passage 50 communicating between the aspirator 40 and the canister 20, a separation container 70 for separating gas contained in the fuel tank T into a fuel component and an air component, and first, second and third passages 81, 82 and 83 communicating between the separation container 70 and the fuel tank T.

The fuel tank T is configured as a substantially hermetically sealed tank and serves to store fuel F to be supplied to an engine of an automobile. A fuel pump 15 is disposed within the fuel tank T for feeding the fuel F into the engine under pressure. More specifically, the fuel pump 15 is configured such that a part of the fuel F discharged from the fuel pump 15 can be supplied to the aspirator 40. As will be explained later, the aspirator 40 can produce a negative pressure by using the flow of the fuel F supplied from the fuel pump 15.

A first pressure sensor 16 is mounted to the fuel tank T for detecting the internal pressure of the fuel tank T and outputting a pressure detection signal to an ECU (engine control unit) (not shown).

(Canister)

The canister 20 is configured as a substantially hermetically sealed container, into which an adsorption material C made of activator carbon or any other suitable material is charged. The canister 20 includes a vapor port 21 connected to the vapor passage 30, a recovery port 22 connected to the recovery passage 50, an atmospheric port 23 connected to the atmospheric passage 60, and a purge port 24 connected to the second passage 82 of the separation container 70. Therefore, the adsorption material C can adsorb fuel vapor that may be introduced from the vapor passage 30 into the canister 20 via the vapor port 21. When the aspirator 40 is operated to apply a negative pressure to the canister 30 via the recovery passage 50 and the recovery port 22, air is supplied from the second passage 82 into the canister 20, so that fuel vapor adsorbed by the adsorption material C may be purged by the air so as to be desorbed from the adsorption material C. Further, a heater 25 is disposed within the canister 20 and can heat the adsorption material C during desorption of the fuel vapor from the adsorption material C. Typically, the adsorption material C that is made of activated carbon or the like has such a characteristic that the fuel vapor can be more easily desorbed from the adsorption material C as the temperature increases.

An atmospheric-side solenoid valve 62 is disposed within the atmospheric passage 60 of the canister 20. The atmospheric-side solenoid valve 62 can close when energized (ON turning), and it can open when non-energized (OFF turning). The atmospheric-side solenoid valve 62 operates according to an operation signal supplied from the ECU. More specifically, the atmospheric-side solenoid valve 62 is opened during filling of fuel into the fuel tank T and when the internal pressure of the fuel tank T becomes equal to or more than a maximum limit value.

(Vapor Passage)

As described previously, the vapor passage 30 serves to introduce the fuel vapor produced within the fuel tank T into the canister 20. A fill-up restriction valve 17 and a cut-off valve 18 are connected to the fuel tank-side end portion of the vapor passage 30. The fill-up restriction valve 17 opens when the level of the fuel F within the fuel tank T is equal to or lower than a fill-up level, while it closes when the fuel level exceeds the fill-up level. To this end, the fill-up restriction valve 17 has a float valve member floating on the fuel surface and moving upward to close the flow passage when the fuel level exceeds the fill-up level. The cut-off valve 18 is positioned at a higher level than the fill-up restriction valve 17 and is normally opened. For example, when the automobile has been overturned by a traffic accident or the like, the cut-off valve 18 can operate to close.

A first solenoid valve 31 and a bi-directional check valve 32 are provided in the midway of the vapor passage 30 and are arranged in parallel relationship to each other. The first solenoid valve 31 can open when it is energized, while it can close when it is not energized. The first solenoid valve 31 operates according to a control signal supplied from the ECU. More specifically, the first solenoid valve 31 is normally closed and can be opened during filling of the fuel into the fuel tank T.

The bi-directional check valve 32 is constituted by a positive pressure valve 32*a* and a negative pressure valve 32*b*. The positive pressure valve 32*a* opens when the internal pressure of the fuel tank T is equal to or more than a predetermined value (e.g., about +5 kPa). The negative pressure valve 32*b* opens when the internal pressure of the fuel tank T is equal to or less than a predetermined value (e.g., −5 kPa). Therefore, for example, if the relationship "+5 kPa>P>−5 kPa" is resulted, both of the positive and negative pressure valves 32*a* and 32*b* are closed. Here, "P" designates the internal pressure of the fuel tank T.

A second solenoid valve 34 is disposed at the canister-side end portion of the vapor passage 30. The second solenoid valve 34 can close when it is energized, while it can open when it is not energized. The first solenoid valve 34 operates according to a control signal supplied from the ECU. More specifically, the second solenoid valve 34 opens when the internal pressure P of the fuel tank T becomes equal to or more than a predetermined value (e.g., +5 kPa) or during collection of the fuel vapor.

In this way, the first solenoid valve 31, the bi-directional check valve 32 and the second solenoid valve 34 serve as a purge passage opening and closing device.

(Aspirator)

Figure 1B:
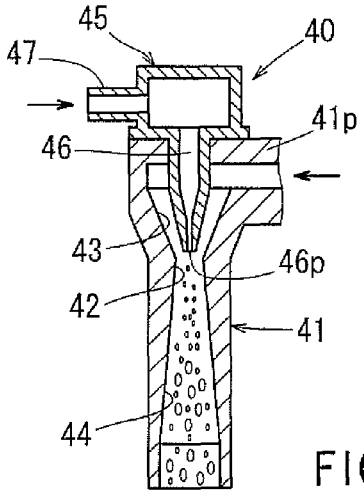
FIG. 1(B) is a vertical sectional view of an aspirator of the fuel vapor processing apparatus.

The aspirator 40 is constructed to generate a negative pressure by utilizing the flow of the fuel F supplied from the fuel pump 15. As shown in FIG. 1(B), the aspirator 40 is constituted by a venturi part 41 and a nozzle part 45. The venturi part 41 defines therein a throttle portion 42, an inlet-side diameter decreasing portion 43 positioned on the upstream side of the throttle portion 42, and an outlet-side diameter increasing portion 44 positioned on the downstream side of the throttle portion 42. In this example, the inlet-side diameter decreasing portion 43, the throttle portion 42 and the outlet-side diameter increasing portion 44 are formed coaxially with each other. A suction port 41*p* for connection with the recovery passage 50 is formed with the upstream-side end of the inlet-side diameter decreasing portion 43 of the venturi part 41.

The nozzle part 45 includes a nozzle body 46 coaxially received within the inlet-side diameter decreasing portion 43 of the venturi part 41. The nozzle body 46 has a jet orifice 46*p* positioned proximal to the throttle portion 42 of the venturi part 41. In addition, a fuel supply port 47 for connection with a branch pipe 15*p* of the fuel pump 15 (see FIG. 1) is formed at the base end (on the side opposite to the jet orifice 46*p*) of the nozzle body 46.

With the above construction, the fuel F supplied from the fuel pump 15 to the aspirator 40 is injected from the jet orifice 46*p* of the nozzle body 46 and flows at a high speed through the throttle portion 42 and the central portion of the outlet-side diameter increasing portion 44 in the axial direction of the venturi part 41. Therefore, the pressure of the region around the throttle portion 42 of the venturi part 41 becomes negative, so that fluid (i.e. the fuel vapor and air) contained within the inlet-side diameter decreasing portion 43 flows toward the downstream side along with the fuel F injected from the nozzle body 46. Hence, fluid (i.e., fuel vapor and other) contained within the recovery passage 50 connected to the suction port 41*p* of the venturi part 41 may be drawn into the venturi part 41. In this way, the aspirator 40 serves as a negative pressure generating device.

(Recovery Passage)

The recovery passage 50 connects between the recovery port 22 of the canister 20 and the suction port 41*p* of the aspirator 40. A unidirectional check valve 52 is mounted to the fuel tank-side end portion of the recovery passage 50. The unidirectional check valve 52 permits flow of fluid from the canister 20 toward the aspirator 40 but prevents flow of fluid from the aspirator 40 toward the canister 20.

A solenoid valve 54 for recovering the fuel vapor (hereinafter called "recovery solenoid valve 54") is provided at the canister side end portion of the recovery passage 50. The recovery solenoid valve 54 can open when it is energized, while it can close when it is not energized. The recovery solenoid valve 54 operates according to a control signal supplied from the ECU. More specifically, the recovery solenoid valve 54 opens when recovering the fuel vapor.

A second pressure sensor 56 is provided in the recovery passage 50 at a position between the recovery solenoid valve 54 and the unidirectional check valve 52. The second pressure sensor 56 outputs its detection signal to the ECU.

In addition, the third passage 83 is connected to the recovery passage 50*f* of the separation container 70 at a position on the upstream side of the second pressure sensor 56.

(Separation Container)

The separation container 70 serves to separate gas, which is introduced from within the fuel tank T, into a fuel component and an air component. The separation container 70 includes a container body 72 and a separation membrane 75 that divides the internal space of the container body 72 into a primary chamber 73 and a secondary chamber 74. The container body 72 has an inlet port 73*e* and a primary output port 73*p* communicating with the primary chamber 73 and connected to the first passage 81 and the second passage 82, respectively. The container body 72 also has a secondary outlet port 74*p* communicating with the secondary chamber 74 and connected to the third passage 83.

The separation membrane 75 preferentially allows passage of the fuel component contained in the gas but inhibits passage of the air component. More specifically, the separation membrane 75 is constituted by a non-porous thin membrane layer and a porous support membrane layer that supports the thin membrane layer. The non-porous thin membrane performs a primary function of the separation membrane 75. For example, the thin membrane layer may be made of silicon rubber that is cross-linked to have a three-dimensional insoluble structure. The porous support membrane layer may be made of ceramic or synthetic resin, such as polyimide (PI), polyetherimide (PEI) and polyvinylidene fluoride (PVDF).

Figure 2:
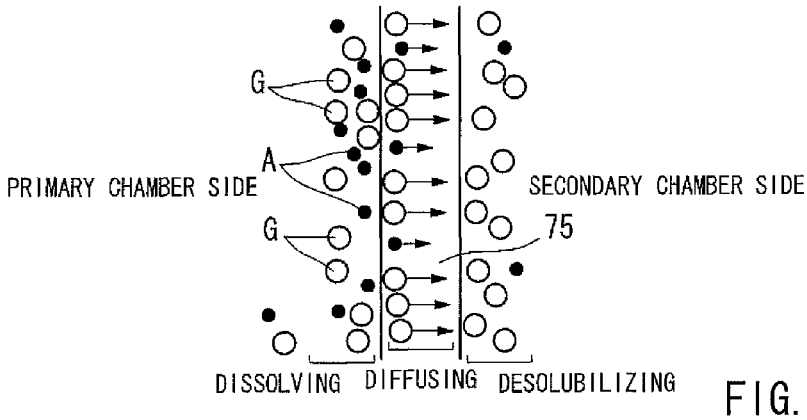
FIG. 2 is a schematic view showing the operation of a separation membrane of a separation device of the fuel vapor processing apparatus.

Referring to FIG. 2, hydrocarbon G is a fuel component and has a high solubility coefficient and a high diffusion coefficient into the separation membrane 75, so that hydrocarbon G can easily pass through the separation membrane 75 by dissolving, diffusing and desolubilizing. On the other hand, air component A, such as nitrogen and oxygen, has a low solubility coefficient and a low diffusion coefficient into the separation membrane 75, so that air component A is difficult to pass through the separation membrane 75. Therefore, when gas within the fuel tank T is introduced into the primary chamber 73 of the separation container 70 in the state that the secondary chamber 74 is kept under a negative pressure, the fuel component of the gas passes through the separation membrane 75 to move into the secondary chamber 74, while air component A remain within the primary chamber 73. Thus, the air component is collected within the primary chamber 73 of the separation container 70, while the fuel component is collected within the secondary chamber 74.

(First to Third Passages)

The first passage 81 is configured to introduce gas within the fuel tank T into the primary chamber 73 of the separation container 70. One end of the first passage 81 is connected to a top port Tp of the fuel tank T, and the other end of the first passage 81 is connected to the inlet port 73*e* of the separation container 70. A tank-side solenoid valve 81*v* is mounted to the first passage 81. The tank-side solenoid valve 81*v* opens when energized (ON turning), while it closes when non-energized (OFF turning). The tank-side solenoid valve 81*v* operates according to an operation signal supplied from the ECU. More specifically, the tank-side solenoid valve 81*v* is opened during recovering of the fuel vapor.

The second passage 82 is configured to introduce the air component collected within the primary chamber 73 of the separation container 70 into the canister 20. One end of the second passage 82 is connected to the primary outlet port 73*p* of the separation container 70, and the other end of the second passage 82 is connected to the purge port 24 of the canister 20. A pressure control valve 82*p* is provided in the second passage 82 and serves to maintain a negative pressure within the canister 20 and also within the secondary chamber 74 of the separation container 70 during recovering of the fuel vapor.

The third passage 83 is configured to introduce the fuel component collected within the secondary chamber 74 of the separation container 70 into the recovery passage 50. One end of the third passage 83 is connected to the secondary outlet port 74*p* of the separation container 70, and the other end of the third passage 83 is connected to the recovery passage 50 at a position on the upstream side of the second pressure sensor 56.

(Operation of Fuel Vapor Processing Apparatus)

Figure 3:
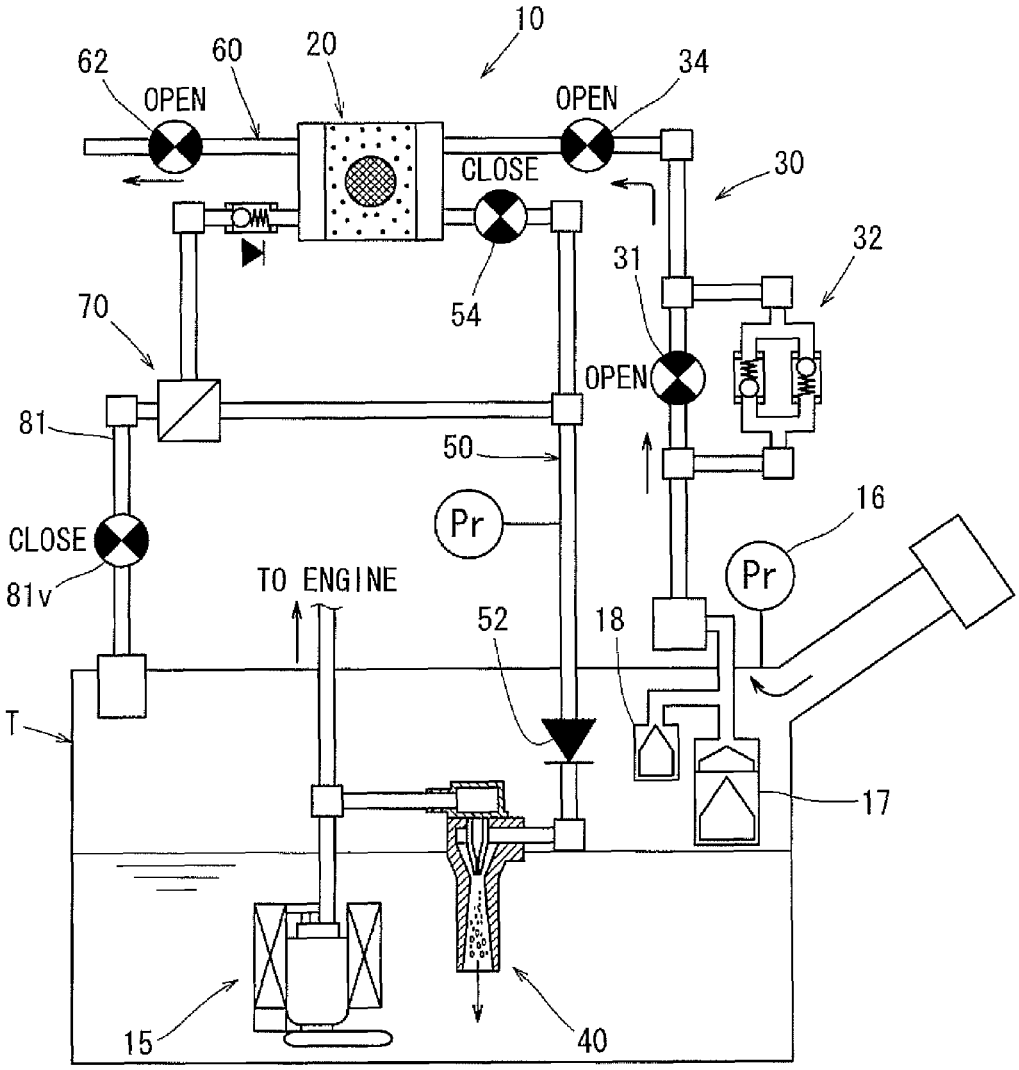
FIGS. 3 and 4 are schematic views showing operations of the fuel vapor processing apparatus.

During filling of the fuel into the fuel tank T, the fist solenoid valve 31 and the second solenoid valve 34 of the vapor passage 30 and the atmospheric side solenoid valve 62 of the atmospheric passage 60 are opened as shown in FIG. 3. On the other hand, the recovery solenoid valve 54 of the recovery passage 50 and the tank-side solenoid valve 81*v* of the first passage 81 of the separation container 70 are closed. Therefore, during filling of the fuel, gas (air and fuel vapor) within the fuel tank T is urged to flow into the vapor passage 30 via the fill-up restriction valve 17 and the cut-off valve 18 and further into the canister 20 by flowing through the first and second solenoid valves 31 and 34 of the vapor passage 30 (see arrows in FIG. 3). Then, the fuel vapor is adsorbed by the adsorption material C of the canister 20, while air remaining after removal of the fuel vapor is discharged from the canister 20 to the atmosphere via the atmospheric-side solenoid valve 62 of the atmospheric passage 60.

As a result, during filling of the fuel, the internal space of the fuel tank T is opened to the atmosphere via the vapor passage 30, the canister 20 and the atmospheric passage 60. Therefore, it is possible to reduce resistance against flow of gas through the vapor passage 30 and the other passages from within the fuel tank T.

Figure 4:
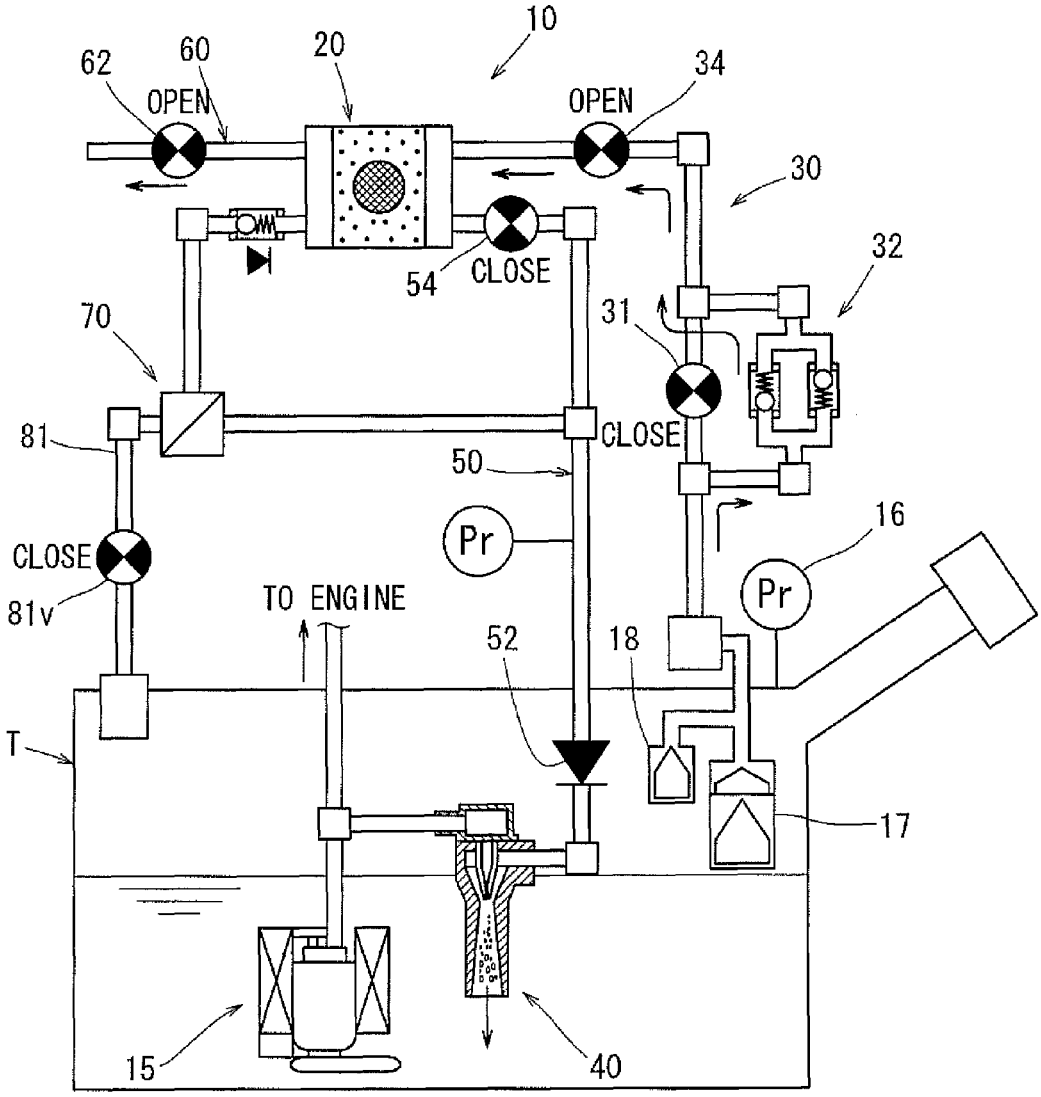
Figure 5:
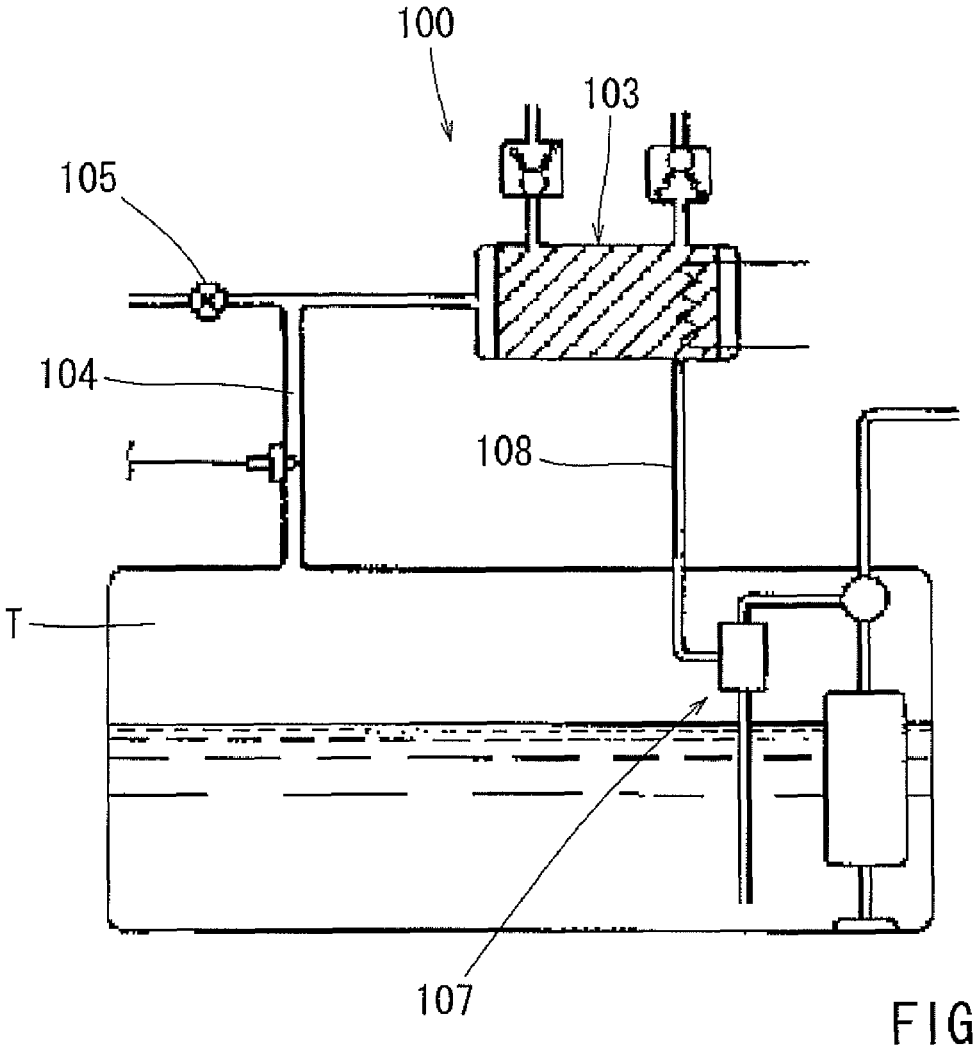
FIG. 5 PRIOR ART
FIG. 5 is a schematic view of a known fuel vapor processing apparatus.

During collection of the fuel vapor, the fist solenoid valve 31 of the vapor passage 30 is closed, while the second solenoid valve 34 of the vapor passage 30 and the atmospheric side solenoid valve 62 of the atmospheric passage 60 are opened as shown in FIG. 4. On the other hand, the recovery solenoid valve 54 of the recovery passage 50 and the tank-side solenoid valve 81*v* of the first passage 81 of the separation container 70 are closed. Therefore, air and fuel vapor within the fuel tank T can flow through the vapor passage 30 as indicated by arrows in FIG. 4 when the internal pressure of the fuel tank T becomes equal to or more than the predetermined pressure (e.g., +5 kPa) set for the positive pressure valve 32*a* of the bi-directional check valve 32. Hence, air and fuel vapor within the fuel tank T flows into the vapor passage 30 via the fill-up restriction valve 17, etc., and further into the canister 20 after flowing through the positive pressure valve 32*a* of the bi-directional check valve 32 and the second solenoid valve 34. Then, fuel vapor is adsorbed by the adsorption material C contained within the canister 20, and air remaining after removal of the fuel vapor is discharged from the canister 20 to the atmosphere via the atmospheric-side solenoid valve 62 of the atmospheric passage 60. In this way, when the internal pressure of the fuel tank T increases to become equal to or more than the predetermined pressure (e.g., +5 kPa), the internal pressure of the fuel tank T is released to the outside, so that the fuel tank T can be protected.

If the relationship "+5 kPa>P>−5 kPa" is resulted for the internal pressure P of the fuel tank T, both of the positive and negative pressure valves 32*a* and 32*b* are closed, and therefore, the fuel tank T can be kept to be sealed from the outside. Therefore, fuel vapor produced within the fuel tank T may not leak to the outside.

When the internal pressure P of the fuel tank becomes equal to or lower than −5 kPa, for example, due to decrease of temperature, the negative pressure valve 32*b* of the bi-directional check valve 32 opens, so that external air may enter the fuel tank T via the atmospheric port 60, the canister 20 and the vapor passage 30. As a result, pressure drop within the fuel tank T can be inhibited, and therefore, the fuel tank T can be protected.

During recovering of the fuel vapor, the fist solenoid valve 31 and the second solenoid valve 34 of the vapor passage 30 and the atmospheric side solenoid valve 62 of the atmospheric passage 60 are closed as shown in FIG. 1(A). On the other hand, the recovering solenoid valve 54 of the recovery passage 50 and the tank-side solenoid valve 81*v* of the first passage 81 of the separation container 70 are opened. In addition, electric power is supplied to the heater 25 within the canister 20, so that the heater 25 heats the adsorption material C contained within the canister 20. Therefore, fuel vapor can be easily desorbed from the adsorption material C.

Further, as the fuel pump 15 is driven, a part of the fuel F discharged from the fuel pump 15 is supplied to the aspirator 40. Therefore, the aspirator 40 is operated, so that fuel vapor and air, etc., stored within the canister 20 are drawn into the aspirator 40 via the recovery passage 50, the recovery solenoid valve 54 and the unidirectional check valve 52. Thus, the interior of the canister 20 is held under a negative pressure, and fuel vapor, etc., stored within the canister 20 is drawn by the aspirator 40. In addition, the inside of the secondary chamber 74 of the separation container 70 communicating with the recovery passage 50 via the third passage 83 becomes substantially equal to the pressure (negative pressure) within the canister 20. Further, due to the operation of the pressure control valve 82*p* operates, a predetermined pressure difference can be maintained between the primary chamber 73 and the secondary chamber 74. Accordingly, gas within the fuel tank T is introduced into the primary chamber 73 of the separation container 70 via the first passage 81 and the tank-side solenoid valve 81*v*.

The fuel component of the gas flown from the fuel tank T into the primary chamber 73 of the separation container 70 passes through the separation membrane 75 so as to be introduced into the secondary chamber 74, while the air component of the gas is remained within the primary chamber 73. The fuel component within the secondary chamber 74 is then introduced into the recovery passage 50 via the third passage 83. On the other hand, the air component within the primary chamber 73 is supplied into the canister 20 via the second passage 82 and the pressure control valve 82*p* in order to purge the adsorption material C within the canister 20. Therefore, it is possible to improve the desorption efficiency of the fuel vapor from the adsorption material C.

The fuel vapor, etc. (e.g., fuel vapor, air, etc.) existing within the canister 20 and the fuel component (those of fuel in vapor or liquid phase) existing within the secondary chamber 74 of the separation container 70 are drawn by the aspirator 40 via the recovery passage 50, the recovery solenoid valve 54 and the unidirectional check valve 52 and are then discharged from the aspirator 40 into the fuel F within the fuel tank T so as to be recovered.

In this way, during recovering of the fuel vapor, the atmospheric side solenoid valve 62 of the atmospheric passage 60 is closed, and therefore, no external air can flow into the fuel tank T via the canister 20 and the recovery passage 50 when the aspirator 40 is operated. As a result, it is possible to prevent the internal pressure of the fuel tank T from increasing.

Thus, in this example, the separation container 70, the separation membrane 75, the aspirator 40 and the pressure control valve 82*p*, etc. serve as a separation device.

(Advantages of Fuel Vapor Processing Apparatus)

According to the fuel vapor processing apparatus 10 of the above example, during recovery of the fuel vapor contained within the canister 20 into the fuel tank T by the operation of the aspirator 40, the air component separated from the gas by the separation membrane 75 of the separation container 70 is supplied from the second passage 82 into the canister 20. Thus, during the time when the fuel component stored within the canister 20 is drawn by the aspirator 40, air is supplied from the second passage 82 into the same canister 20. Therefore, the canister 20 is purged with air, so that the recovery efficiency of the fuel component contained within the canister 20 can be improved. In other words, the time required for recovering the fuel component can be shortened.

Further, because air supplied from the second passage 82 into the canister 20 is that remaining after removal of a fuel component from gas contained within the fuel tank T, the pressure within the fuel tank T may not increase even in the case that such air is drawn together with the fuel component contained within the canister 20 by the aspirator 40 and is returned into the fuel tank T.

Furthermore, use of the separation membrane 45 allows to separate gas, which is introduced from within the fuel tank T, into an air component and a fuel component by incorporating a simple construction.

<Possible Modifications>

The above example can be modified in various ways. For example, in the above example, the separation container 70 having the separation membrane 75 is used for separating gas, which is introduced from within the fuel tank T, into an air component and a fuel component. However, the separation container 70 may be replaced with a cooling container that can cool gas, which is introduced from within the fuel tank T, in order to liquefy the fuel component for separating from the air component.

Furthermore, the bi-directional check valve 32 of the vapor passage 30 can be replaced with solenoid valves corresponding to the positive pressure valve 32*a* and the negative pressure valve 32*b* and operating according to the internal pressure of the fuel tank T and the internal pressure of the canister 20.

Furthermore, the aspirator 40 can be replaced with a negative pressure pump or a vacuum pump.

Furthermore, the fuel supply port 47 of the aspirator 40 may directly receive the supply of the pressurized fuel from the fuel pump 15 or a fuel pump unit. It is also possible that the fuel supply port 47 of the aspirator 40 receives the supply of the pressurized fuel diverged from a return pipe of a fuel pressure regulator (not shown).

This invention claims:

1. A fuel vapor processing apparatus comprising:

a vapor passage capable of introducing fuel vapor into a canister, the fuel vapor being produced within a fuel tank of an automobile:

an atmospheric-side opening and closing device provided at the canister;

a negative pressure generating device disposed within the fuel tank and capable of generating a negative pressure;

a recovery passage communicating between the negative pressure generating device and the canister, so that fuel vapor contained within the canister can be recovered into the fuel tank through the recovery passage by the operation of the negative pressure generating device; and a vapor passage opening and closing device capable of opening and closing the vapor passage;

a separating device capable of separating gas, which is introduced from within the fuel tank, into an air component and a fuel component;

wherein during recovering of fuel vapor within the canister into the fuel tank by the operation of the negative pressure generating device, on the condition that the atmospheric-side opening and closing mechanism and the vapor passage opening and closing device are closed, the air component separated from the gas by the separation device can be supplied to the canister.

2. The fuel vapor processing apparatus as in claim 1, wherein the separation device comprises:

a separation membrane through which the fuel component can easily pass but the air component is difficult to pass;

a container separated into a primary chamber and a secondary chamber by the separation membrane;

a pressure difference producing device capable of producing a pressure difference between the primary chamber and the secondary chamber; and wherein gas within the fuel tank is introduced into the primary chamber, and a fuel component separated from the gas by the separation membrane is introduced into the second chamber.

3. The fuel vapor processing apparatus as in claim 1, wherein the separation device comprises a container capable of cooling gas introduced from within the fuel tank, so that a fuel component of the gas is liquefied and an air component of the gas are separated from the gas.

4. A fuel vapor processing apparatus comprising:

a canister having therein an adsorption material capable of adsorbing fuel vapor produced within a fuel tank of an automobile;

wherein the canister has a first side and a second side opposite to the first side with respect to the adsorption material;

a fuel vapor introducing passage and a fuel vapor recovering passage each communicating between the fuel tank and the first side of the canister, so that fuel vapor produced within the fuel tank can be introduced into the canister via the fuel vapor introducing passage and fuel vapor contained within the canister can be recovered into the fuel tank via the fuel vapor recovering passage;

a purge air supply device including a separation device coupled between the fuel tank and the second side of the canister;

wherein the separation device can separate gas introduced from within the fuel tank into an air component and a fuel component, so that the air component can be supplied to the second side of the canister for purging the adsorption material.

5. The fuel vapor processing apparatus as in claim 4, wherein the purge air supply device further includes:

a first passage communicating between the fuel tank and the separation device, so that gas within the fuel tank can be supplied to the separation device via the first passage;

a second passage communicating between the separation device and the second side of the canister, so that the air component separated by the separation device can be supplied to the second side of the canister; and a third passage communicating between the separation device and the fuel vapor recovering passage, so that the fuel component separated by the separation device can flow into the fuel vapor recovering passage.

6. The fuel vapor processing apparatus as in claim 5, the purge air supply device further comprising:

an opening/closing valve disposed in the first passage and capable of opening and closing the first passage; and a check valve disposed in the second passage.

7. The fuel vapor processing apparatus as in claim 4, further comprising an atmospheric passage communicating between the second side of the canister and an atmosphere.

8. The fuel vapor processing apparatus as in claim 7, further comprising:

a first valve disposed in the fuel vapor introducing passage and capable of opening and closing the fuel vapor introducing passage;

a second valve disposed in the fuel vapor recovering passage and capable of opening and closing the fuel vapor recovering passage; and a third valve disposed in the atmospheric passage and capable of opening and closing the atmospheric passage.

9. The fuel vapor processing apparatus as in claim 7, wherein the atmospheric passage is provided independently of the purge air supply device.

10. The fuel vapor processing apparatus as in claim 4, further comprising a pump device disposed in the fuel vapor recovering passage and capable of producing a flow of fuel vapor from the canister into the fuel tank.

11. The fuel vapor processing apparatus as in claim 10, wherein the pump device is driven by a flow of fuel supplied from a fuel pump that is disposed within the fuel tank for feeding the fuel to an automobile engine.

* * * * *